US006582152B2

(12) United States Patent
Leone et al.

(10) Patent No.: US 6,582,152 B2
(45) Date of Patent: Jun. 24, 2003

(54) ZERO CLEARANCE VARIABLE WIDTH CONCRETE PAVING MACHINE

(75) Inventors: John Leone, Williamsville, NY (US); Steven D. Federowicz, Alden, NY (US)

(73) Assignee: Leone Construction Company, Cheektowaga, NY (US)

( * ) Notice: Subject to any disclaimer, the term of this patent is extended or adjusted under 35 U.S.C. 154(b) by 0 days.

(21) Appl. No.: 09/851,902

(22) Filed: May 9, 2001

(65) Prior Publication Data

US 2002/0044831 A1 Apr. 18, 2002

Related U.S. Application Data

(60) Provisional application No. 60/203,693, filed on May 11, 2000.

(51) Int. Cl.[7] ..... E01C 19/12; E01C 7/32

(52) U.S. Cl. ..... 404/75; 404/105

(58) Field of Search ..... 404/101, 104, 404/105, 106, 75

(56) References Cited

U.S. PATENT DOCUMENTS

| | | | | | |
|---|---|---|---|---|---|
| 3,354,801 | A | * | 11/1967 | Hanson | 404/105 |
| 3,557,672 | A | | 1/1971 | Shurtz et al. | 94/44 |
| 3,572,227 | A | | 3/1971 | Poulsen | 94/45 |
| 3,613,530 | A | | 10/1971 | Hess | 94/46 |
| 3,678,817 | A | | 7/1972 | Martenson et al. | 94/46 |
| 3,880,542 | A | | 4/1975 | Mullen | 404/101 |
| 3,907,451 | A | | 9/1975 | Fisher et al. | 404/101 |
| 3,967,912 | A | | 7/1976 | Parker | 404/84 |
| 3,969,035 | A | | 7/1976 | Silbernagel | 404/98 |
| 3,970,405 | A | | 7/1976 | Swisher, Jr. et al. | 404/105 |
| 3,992,124 | A | | 11/1976 | Schrader | 404/118 |
| 4,012,160 | A | | 3/1977 | Parker | 404/84 |
| 4,029,165 | A | | 6/1977 | Miller et al. | 180/6.48 |
| 4,073,592 | A | * | 2/1978 | Godberson et al. | 404/105 |
| 4,074,802 | A | | 2/1978 | Hudis | 198/315 |
| 4,145,154 | A | | 3/1979 | Mingot | 404/81 |
| 4,197,032 | A | * | 4/1980 | Miller | 172/108 |
| 4,272,213 | A | | 6/1981 | McGovarin | 404/118 |
| 4,289,421 | A | * | 9/1981 | Sampey et al. | 404/106 |
| 4,332,505 | A | | 6/1982 | Mauldin | 404/108 |
| 4,360,293 | A | | 11/1982 | Wade | 405/268 |
| 4,379,653 | A | | 4/1983 | Brown | 404/118 |
| 4,493,585 | A | * | 1/1985 | Axer | 404/102 |
| 4,678,365 | A | | 7/1987 | Ban et al. | 404/118 |
| 4,688,965 | A | | 8/1987 | Smith et al. | 404/75 |
| 4,702,642 | A | | 10/1987 | Musil | 404/118 |
| 4,717,282 | A | | 1/1988 | Anderson | 404/122 |
| 4,749,304 | A | | 6/1988 | Craig | 404/101 |
| 4,772,156 | A | * | 9/1988 | Craig | 404/101 |
| 4,775,262 | A | | 10/1988 | Guntharp et al. | 404/103 |
| 4,778,305 | A | | 10/1988 | Ritchey et al. | 404/105 |
| 4,789,266 | A | | 12/1988 | Clarke, Jr. et al. | 404/96 |
| 4,808,026 | A | | 2/1989 | Clarke, Jr. et al. | 404/90 |
| 4,818,140 | A | | 4/1989 | Carlson | 404/118 |
| 4,861,191 | A | | 8/1989 | Smith et al. | 404/104 |
| 4,900,186 | A | | 2/1990 | Swisher, Jr. et al. | 404/105 |
| 4,948,292 | A | | 8/1990 | Haven et al. | 404/84 |

(List continued on next page.)

*Primary Examiner*—Gary Hartmann
(74) *Attorney, Agent, or Firm*—Hodgson Russ LLP

(57) ABSTRACT

The invention teaches a slip form paving machine which can be used for both zero clearance variable width and variable width conventional paving using the same paving pan. The main frame of the machine is designed to hydraulically extend and retract from varying desired widths. The paving assembly, attached to the main tractor assembly frame, is adjustable as wide as the width of the main frame of the machine or further past the exterior limits for additional clearance, if required. The paving pan, which is part of the pan assembly, can also be extended to conform to these various widths. In a "zero clearance" paving mode, the same pan is located behind the main tractor frame, whereas in conventional paving, the pan is located under the center of the main frame inside of the tracks. In addition, the paving pan can be adjusted to pave varying surface angles, if required.

5 Claims, 12 Drawing Sheets

U.S. PATENT DOCUMENTS

| | | | | | |
|---|---|---|---|---|---|
| 4,988,233 | A | | 1/1991 | Kasler et al. | 404/108 |
| 4,993,869 | A | | 2/1991 | Ulmer et al. | 404/117 |
| 5,073,063 | A | | 12/1991 | Brown | 404/101 |
| 5,203,642 | A | | 4/1993 | Heller et al. | 404/118 |
| 5,222,829 | A | | 6/1993 | Mogler et al. | 404/118 |
| 5,348,418 | A | | 9/1994 | Campbell | 404/103 |
| 5,405,214 | A | | 4/1995 | Campbell | 404/80 |
| D362,449 | S | | 9/1995 | Swisher, Jr. | D15/22 |
| 5,452,966 | A | | 9/1995 | Swisher, Jr. | 404/72 |
| 5,470,175 | A | | 11/1995 | Jensen et al. | 404/72 |
| 5,480,256 | A | | 1/1996 | Itsekson et al. | 404/72 |
| D370,917 | S | | 6/1996 | Swisher, Jr. | D15/24 |
| 5,529,434 | A | | 6/1996 | Swisher, Jr. | 404/108 |
| 5,531,542 | A | | 7/1996 | Willis | 404/101 |
| 5,533,828 | A | | 7/1996 | Campbell | 404/75 |
| 5,533,829 | A | | 7/1996 | Campbell | 404/81 |
| 5,567,075 | A | | 10/1996 | Allen | 404/84.5 |
| 5,590,977 | A | | 1/1997 | Guntert et al. | 404/101 |
| 5,615,972 | A | | 4/1997 | Guntert et al. | 404/72 |
| 5,647,688 | A | | 7/1997 | Guntert et al. | 404/101 |
| 5,662,431 | A | | 9/1997 | Colvard | 404/105 |
| 5,791,815 | A | | 8/1998 | Rowe | 404/103 |
| 5,857,804 | A | | 1/1999 | Musil | 404/104 |
| 5,863,149 | A | | 1/1999 | Gustin | 404/104 |
| 5,924,817 | A | * | 7/1999 | Godbersen | 404/100 |
| 5,941,659 | A | * | 8/1999 | Godbersen | 404/88 |
| 5,980,153 | A | * | 11/1999 | Plemons et al. | 198/657 |
| 6,007,272 | A | | 12/1999 | Macku et al. | 404/92 |
| 6,019,544 | A | | 2/2000 | Emerson et al. | 404/104 |
| 6,086,287 | A | | 7/2000 | Sharpe et al. | 404/75 |
| 6,099,205 | A | | 8/2000 | Macku et al. | 404/92 |
| 6,158,921 | A | | 12/2000 | Holmes | 404/104 |
| 6,174,105 | B1 | * | 1/2001 | Holmes et al. | 404/104 |

* cited by examiner

ZERO CLEARANCE VARIABLE WIDTH CONCRETE PAVING MACHINE

CROSS-REFERENCE TO RELATED APPLICATION

The present application claims priority based on provisional application Ser. No. 60/203,693 filed May 11, 2000.

BACKGROUND OF THE INVENTION

1. Field of the Invention

The invention relates to a concrete paving machine. More specifically, the invention relates to a zero clearance, variable width paving machine which allows laying a paving bed beyond the tracks of the paving machine up to a curb or other vertical surface. Paving of this nature can be accomplished from one or both sides of the current invention paving machine. The paving pan is located behind the tractor and can be expanded to or past the dimension of the paver tracks. Thus, the current paving machine provides zero clearance paving which negates completion of a paving job with a subsequent pass to cover the area occupied by the tracks as is the case with prior art paving machines. Using the same paving pan, the machine can also provide variable width conventional paving.

Slip form pavers have been widely used to pave concrete surfaces, and in general comprise a tractor unit supported on track assemblies with a propulsion means, steering means and elevational control. Using this tractor for conventional paving, a paving pan is located near the mid-point of the tractor, consisting of a spreading auger, vibration means for consolidation of the concrete, and a screed. On each side of the paving pan inside of the traction means are the lateral forms which create the side edges of the concrete slab formed on the roadway as the machine moves forward.

In general, when applying a concrete slab to a road surface using the above described slip form paver, the road surface must be of sufficient width to accommodate the slab and a track path on each side of the slab for track travel. The width of a particular track path generally is equal to that portion of the outboard track extending the greatest distance beyond the respective concrete slab side forms. The dimension between the outer edge of the track path and the respective outer edge of the concrete slab applied is the offset or clearance requirement of the paver. In the current invention, this dimension can be zero, and hence the term "zero clearance" paving.

In many cases a vertical abutment such as a curb or highway center median may border the road surface such that the outboard tracks cannot travel upon or straddle the raised structure. In these instances heretofore, a number of varied complicated procedures had to be followed to complete the paving operation. However, the method and apparatus of the current invention provides an improved paving apparatus capable of simultaneously applying a concrete slab of varying width over the surface to be paved and directly against a vertical abutment located on either or both sides of the machine, negating complicated finishing procedures.

2. Prior Art

The prior art does not disclose a concrete paver which can pave at zero clearance from either or both sides of the machine concrete slabs of varying dimensional width.

Now referencing the prior art patents, U.S. Pat. No. 4,900,186 to Swisher et al teaches a method and apparatus of providing a paving apparatus capable of simultaneously applying a concrete slab of substantial width over the surface to be paved and directly against a vertical abutment. This prior art machine, however, paves against a vertical abutment on only one side, in contrast to the current invention, which can do this on either side.

Also, in U.S. Pat. No. 3,992,124 to Schrader, the art teaches a device for adjusting the working width of a road finisher comprising a main support beam adapted to be carried by the road finisher located behind the machine for finishing the road surface. The width of the device is variable and, therefore, could be used to finish concrete exterior to an area between the tracks of the vehicle and a curb. However, the invention does not teach the use of available width distribution means, which contrasts this patent from the current invention.

U.S. Pat. No. 4,988,233 to Kaslev et al teaches a method and apparatus of providing a paving apparatus capable of simultaneously applying a concrete slab of substantial width over the surface to be paved and directly against a vertical abutment. It may be paved against a vertical abutment from either side. This prior art machine can only pave a fixed width, whereas the current invention can pave a variable width slab of up to several lanes at one time.

SUMMARY OF THE INVENTION

The invention teaches a slip form paving machine which can be used for both zero clearance variable width and variable width conventional paving. The main frame of the machine is designed to hydraulically extend to varying desired widths. The paving assembly, attached to the main tractor assembly frame, can be contemporaneously adjusted as wide as the main frame of the machine or further past the exterior limits for additional clearances, if required. The paving pan, part of the pan assembly, also can be extended to conform to these various widths. In a "zero clearance" paving mode, the pan is located behind the main tractor frame, whereas in conventional paving, the same pan is located under the center of the main frame inside of the tracks. The current invention can zero clearance pave from either side or both. In addition, the paving pan can be adjusted to pave varying surface angles, if required.

The foregoing and additional advantages and characterizing features of the present invention will become clearly apparent upon reading of the following detailed description together with the included drawings.

BEST MODE FOR CARRYING OUT THE INVENTION

Figure 1:
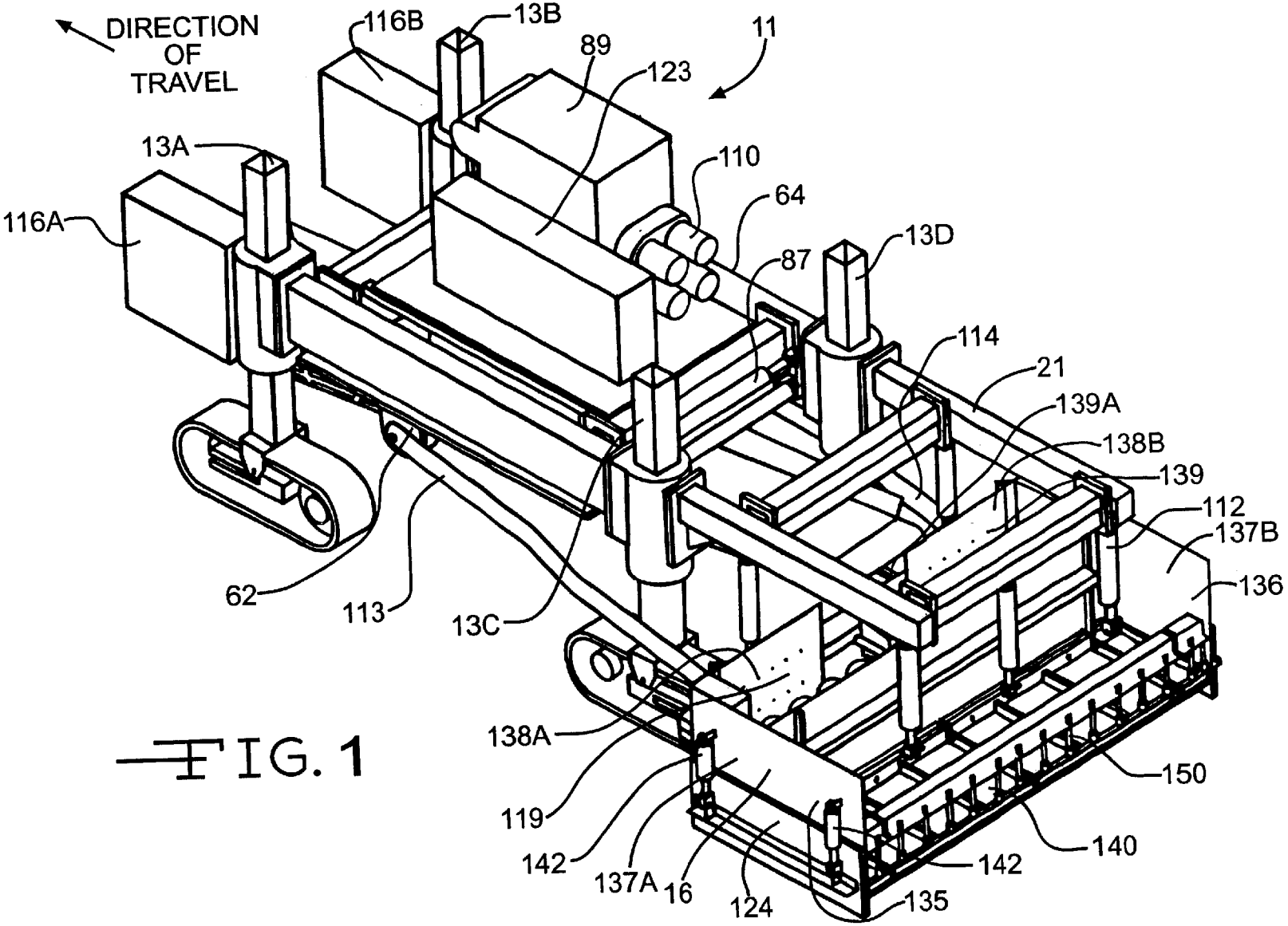
FIG. 1 is a perspective view of the paving machine in an unexpanded zero clearance paving mode.

The zero clearance paver 11 will be hereinafter described in detail. Now, referring to FIGS. 1 through 4, the main support frame 20, consists of spaced apart telescoping transverse members 22 and 24 extending to and meeting with longitudinal beams 26 and 28. Longitudinal beams are those beams which are parallel to the general direction of travel. The first and second longitudinal beams 26 and 28 are generally rectangular in cross section, and beams 26 and 28 are mirror images of each other. The first beam 26 consisting of spaced apart side walls 30A and 32A extending to and meeting with upper end wall 34A at rounded surfaces and side walls 30A and 32A further extending downward and meeting lower wall 36A at rounded surfaces. The second longitudinal beam 28 consists of spaced apart side walls 30B and 32B extending to and meeting with upper wall 34B at rounded corners. Side walls 30B and 32B further extending down to and meeting with lower wall 36B at rounded corners.

Figure 10:
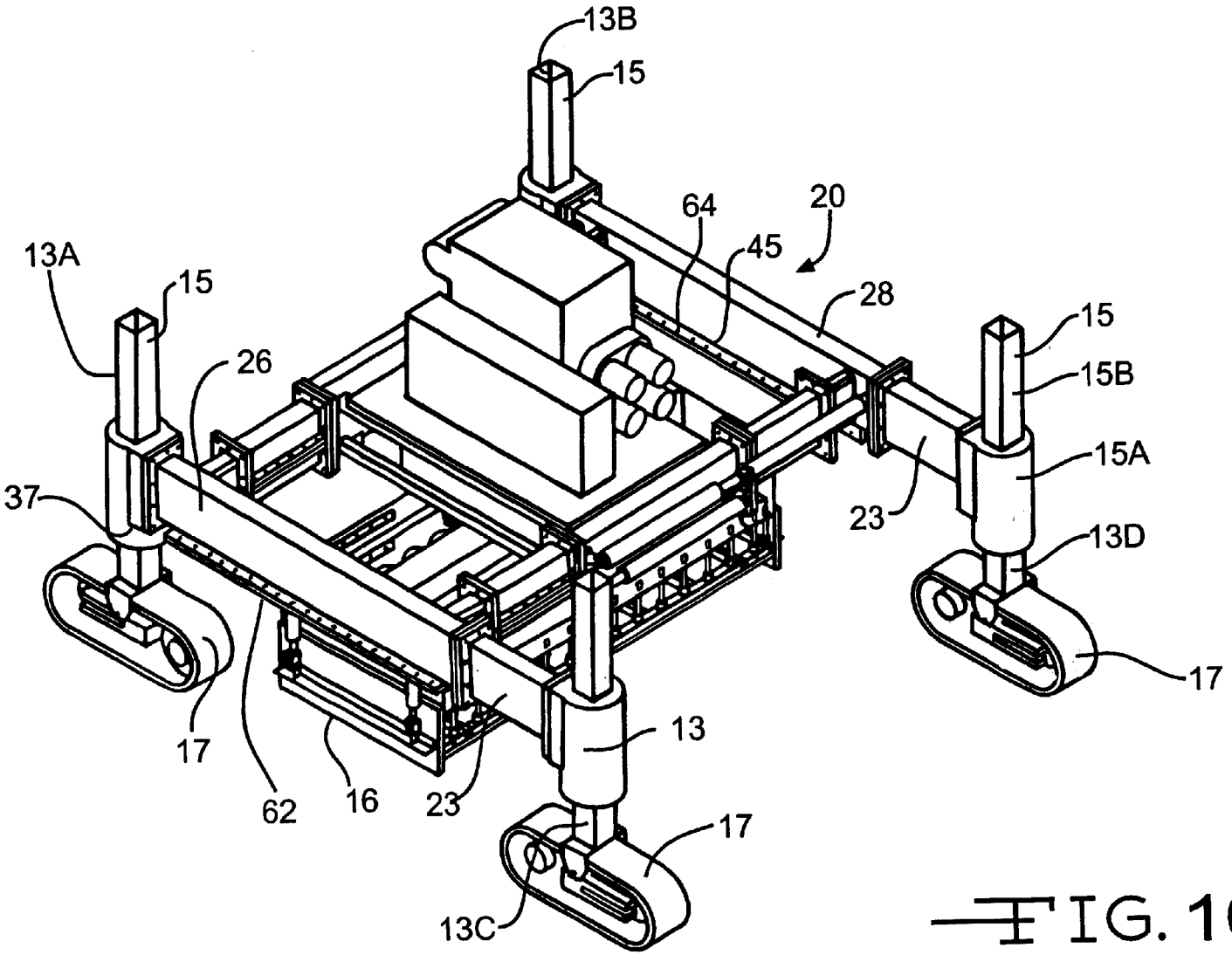
FIG. 10 is a perspective view showing the paving machine in a 10-foot wide conventional paving mode.

In the first longitudinal beam 26, walls 30A, 32A, 34A, and 36A extend to and meet with plates 46A and 48A. Plates 46A and 48A are identical in structure, generally rectangular, consisting of spaced apart side walls 50A and 52A extending to and meeting with upper end wall 54A, further extending and meeting with lower end wall 56A. Walls 50A, 52A, 54A, and 56A extend to and meet with upper surface 58A on plate 46A and the upper surface 58A on plate 48A. Plates 46A and 48A both contain a lower surface 60B. Plates 46A and 48A are suited for connection to a motion means, generally indicated at 13, or an extension 23 depending on the application (FIG. 10).

As stated previously, the second longitudinal beam 28 is mirrored to the first longitudinal beam 26. In the second longitudinal beam 28 walls 30B, 32B, 34B, and 36B extend to and meet with plates 46B and 48B. Plates 46B and 48B are identical in structure, generally rectangular, consisting of spaced apart side walls 50B and 52B extending to and meeting with upper end wall 54B and lower end wall 56B. Walls 50B, 52B, 54B, and 56B extend to and meet with upper surface 58B on plate 46B and upper surface 58B on plate 48B. Plates 46B and 48B both contain a lower surface 60B. As stated previously, plates 46B and 48B are suited for connection to a tractor mechanism 12 or an extension 23 depending on the application.

Lower walls 36A and 36B have support members 62 and 64 attached, respectively. Support members 62 and 64 are identical, attached to lower surface 37 of wall 36A and surface 45 of wall 36B, respectively. The first support member 62 consists of spaced first and second end walls 66A and 68A extending to and meeting with side wall 70A. The first and second end walls 66A and 68A further extend to and meet with side wall 72A. Side wall 70A is parallel to side wall 72A. Second support member 64 consists of spaced first and second end walls 66B and 68B extending to and meeting with side wall 70B. The first and second end walls 66B and 68B further extending to and meeting with side wall 72B. Side wall 70B is parallel to side wall 72B.

The main support frame 20 further consists of first and second transverse support members 22 and 24. The first and second members 22 and 24 respectively are mirrored. Each transverse support member is designed to allow three structural tubes to be inserted inside of each other. Thus, each outer tube is designed to restrain the tube directly inside of it as the frame extends. Collars, generally illustrated at 18, are required to envelope the extended tube to provide support. Each collar is designed using the exterior dimension of the tube directly to the outside of the extension for the inside dimension of the collar. Collars 18 contain at least one component placed over the extended tube and are attached to the main tractor frame 20. Multiple collars may be necessary depending on the paving width. The multiple collars, in addition to being attached to the frame, are attached to each other. Collars will be discussed in detail later.

The first transverse beam 22 consists of a first box beam 74A having side walls 76A and 78A extending to and meeting with top wall 80A and with lower wall 82A. Walls 76A, 78A, 80A and 82A extend to and meet with a first plate flange 83A and a second plate flange 84A. Plate flanges 83A and 84A are identical. Side wall 76A contains at least one tie lug (FIG. 7), generally illustrated at 85, used for a hydraulic assist cylinder, generally illustrated at 87. Nested inside of box beam 74A is a second box beam 86A, of smaller cross-sectional area, capable of being extended to increase capability to pave various widths as required. Nested inside of the second box beam 86A is a third box beam 88A also capable of extension for pavement widths in excess of a standard width. Second box beam 86A extends to and meets perpendicularly with first longitudinal beam 26 whereas the third box beam 88A extends to and meets perpendicularly with second longitudinal beam 28.

Figure 5:
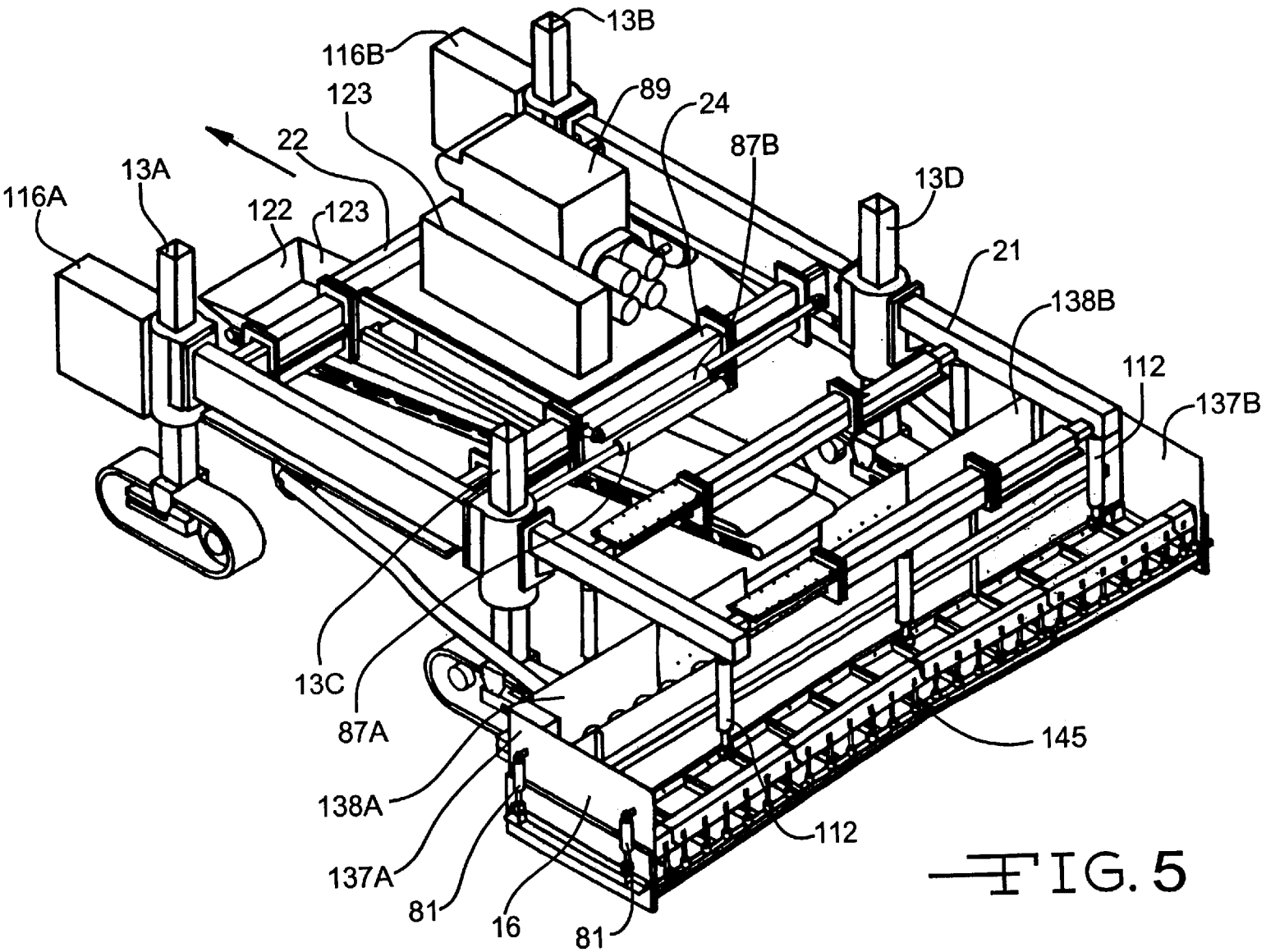
FIG. 5 is a perspective view of the paving machine in an expanded zero clearance mode with a center elevated paving pan.

The second traverse beam 24 consists of a first box beam 74B having side walls 76B and 78B extending to and meeting with top wall 80B and lower wall 82B. Walls 76B, 78B, 80B and 82B extend to and meet with a first plate flange 83B and a second plate flange 84B. Plate flanges 83B and 84B are identical. Side wall 76B contains at least one tie lug 85 used for a hydraulic assist cylinder, generally illustrated at 87 (FIG. 5). Nested inside of box beam 74B is a second box beam of smaller cross-sectional area 86B capable of being extended to increase the desired pavement width as required. Nested inside of the second box beam 86B is a third box beam 88B capable of extension for pavement widths in excess of a standard width. Second box beam 86B extends to and meets perpendicularly with first longitudinal beam 26 whereas third box beam 88B extends to and meets perpendicularly with second longitudinal beam 28. In this embodiment of the invention per FIG. 2, the first box beam 74 is designed to stabilize the second box beam 86, and the second box beam is designed to stabilize the third beam 88.

In the fully extended position, a significant portion of the second box beam 86 and the third box beam 88 remain nested inside the first box beam 74. However, in extended positions, transverse beams 22 and 24 require additional stabilization to minimize movement and insure structural stability. Collars, generally illustrated at 18, in the embodiment of the second box beam 86 shown in FIGS. 2 and 3, consists of a multipart frame having first and second parts 91 and 93, which are identical. The first part 91 has spaced apart side walls 90A and 94A extending to and meeting with upper wall 95A. Side wall 90A further extends down to and meets perpendicularly with terminal wall 96A. Side wall 94A extends down and meets perpendicularly with wall 97A. The first part walls 90A, 94A, 95A, 96A and 97A extend to and meet perpendicularly with a first half flange 98A at a 90° angle and walls 94A, 95A, 96A and 97A further extend to and meet with a second half flange 99A at a 90° angle. Flange 98A is mated with half flange 98B and half flange 99A is mated to match with half flange 99B. In a similar manner, the second part 93 having walls 90B, 94B, 95B, 96B and 97B extends to and meets perpendicularly with a first half flange 98B at a 90° angle, and walls 94B, 95B, 96B and 97B extend to and meet with a second end flange 99B at a 90° angle. The first part 91 and the second part 93 are placed over the third box beam 88 such that the opening 100 created by mating the first and second portions 91, 93 of the collar is sufficiently large to fit over the extended portion of the second beam 24. Walls 96A and 96B and 97A and 97B are mated when the collar is attached. A number of collars, generally illustrated at 18, may be provided for increased stability. The collars may be attached to the first or second traverse beams 22 or 24, to the first or second longitudinal beam 26 or 28, or both, depending on the paving width.

A similar collar, generally illustrated at 19, is provided on the second box beam 86, and is suitably dimensioned to fit over the exterior surface 79 of the third box beam 88. As previously stated, a number of collars may be necessary depending on the width to be paved and the extent of frame expansion. The collar 19 may be attached to either of the transverse beams 22 and 24, to the longitudinal beams 26 or 28, or to both.

The frame further includes identical support members generally shown as 127 to stabilize the frame. In the embodiment shown in FIG. 3, this includes supports 127A, 127B, 127C and 127D which extend from about the midpoint of transverse beam 22 to the midpoint of transverse beam 24.

Figure 11:
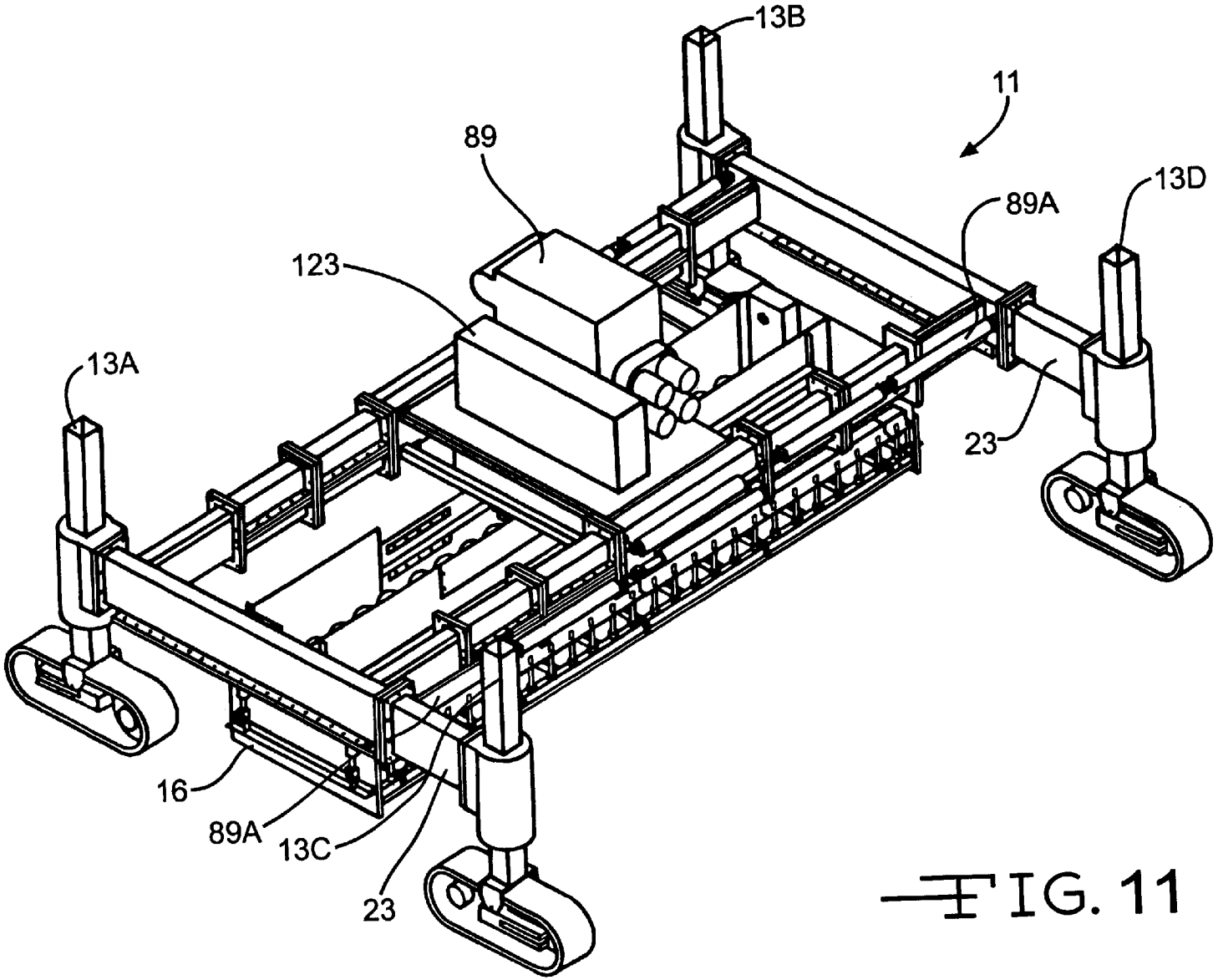
FIG. 11 is a perspective view showing the paving machine in a conventional paving mode in excess of 10 feet.

Now referring to FIGS. 5 through 9, the first and second transverse beams 22 and 24 are equipped with power means to extend the first and second traverse beams to pave concrete widths in excess of 10 feet. The power means includes a hydraulic unit 89 and cylinders 87A, 87B, 87C and 87D. Hydraulic cylinder 87C is attached to the first longitudinal beam 26 and the first transverse beam 22, whereas hydraulic cylinder 87D is attached to the second longitudinal beam 28 and the first traverse beam 22. Similarly, hydraulic cylinder 87B is attached to the first longitudinal beam 26 and the second traverse beam 24 and hydraulic cylinder 87A is attached to the second longitudinal beam 28 and the second traverse beam 24. Extensions to the hydraulic cylinders, generally illustrated at 89A, may be necessary at wider widths (FIG. 11).

A means for motion, generally designated as 13, is shown in FIG. 10 and consists of a vertical support 15 attached to a track mechanism 17 which generally moves in the direction of travel of the paving machine 11. The vertical support contains an adjustable collar 15A. The collar 15A is located in a closely spaced relationship around the exterior surface 15B of the vertical support 15. The collar adjusts to set the initial elevation of the main support frame 20. The track mechanism 17 may rotate at least ±45° from the direction of travel, whereby the track mechanisms 17 are angled outwardly from or inwardly to the transverse beams 22 and 24 to assist in the expansion of the machine frame 20 by movement of the track mechanism 17 away from the frame 20 to hydraulically expand the machine, and toward the frame 20 to collapse the machine.

Figure 4:
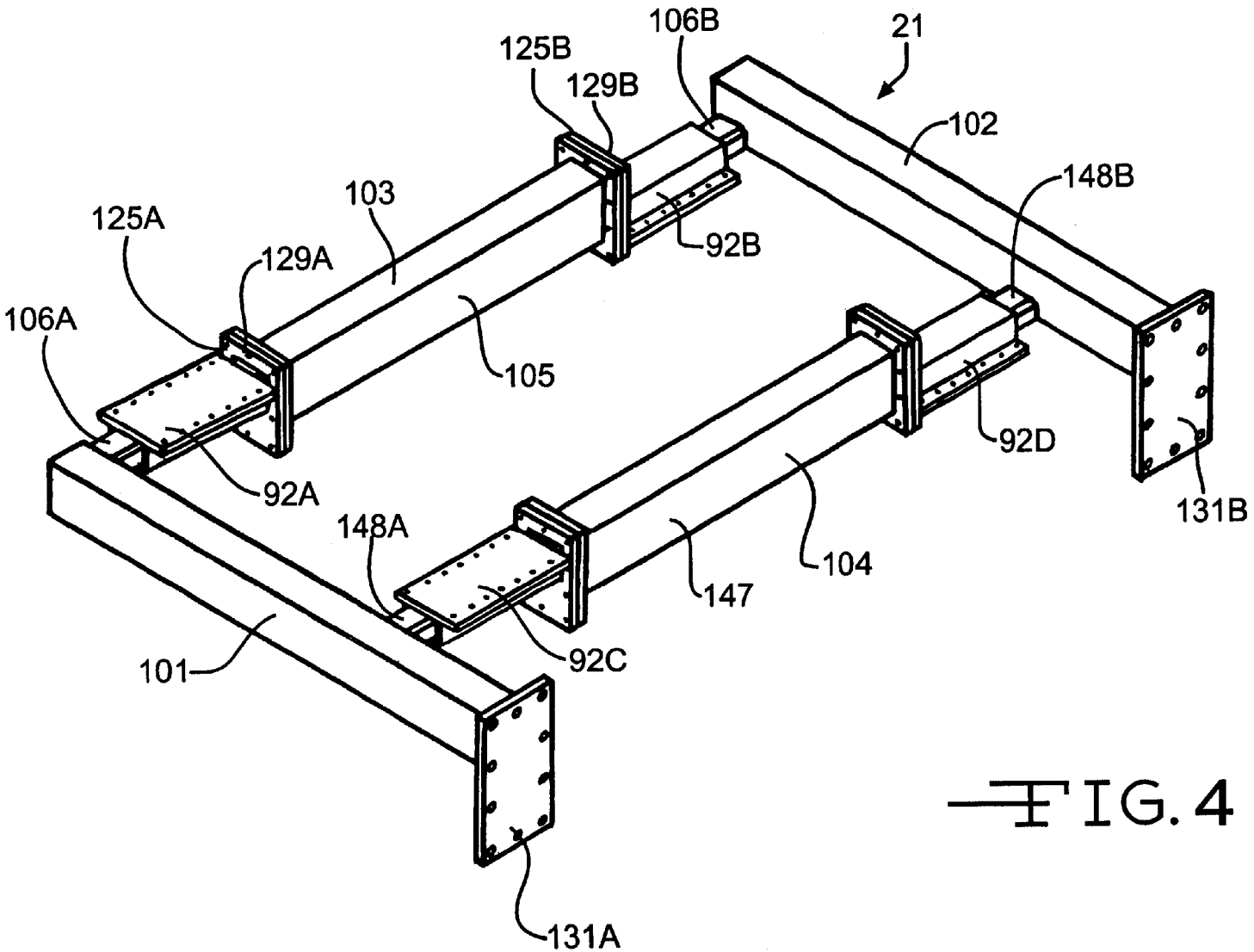
FIG. 4 is a perspective view of the pan support frame.

The pan support 21 as shown in FIG. 4, is designed to be added on to the mainframe 20 assembly upon assembling the zero-clearance paving pan. The support frame 21 is designed to expand along with the main frame as it is expanded. When the main frame is expanded to the desired width, the pan support frame can be locked into position by tightening threaded locking bolts (not shown). As previously described, the pan support frame 21 will support the paving pan assembly 16 using hydraulic cylinders 112 (FIGS. 1 and 5). Tn the unexpanded frame 21, at least four hydraulic cylinders 112 are used to raise and lower the paving pan assembly 16. Additional cylinders 112 may be required when the pan support frame 21 and associated pan assembly 16 extend.

Figure 7:
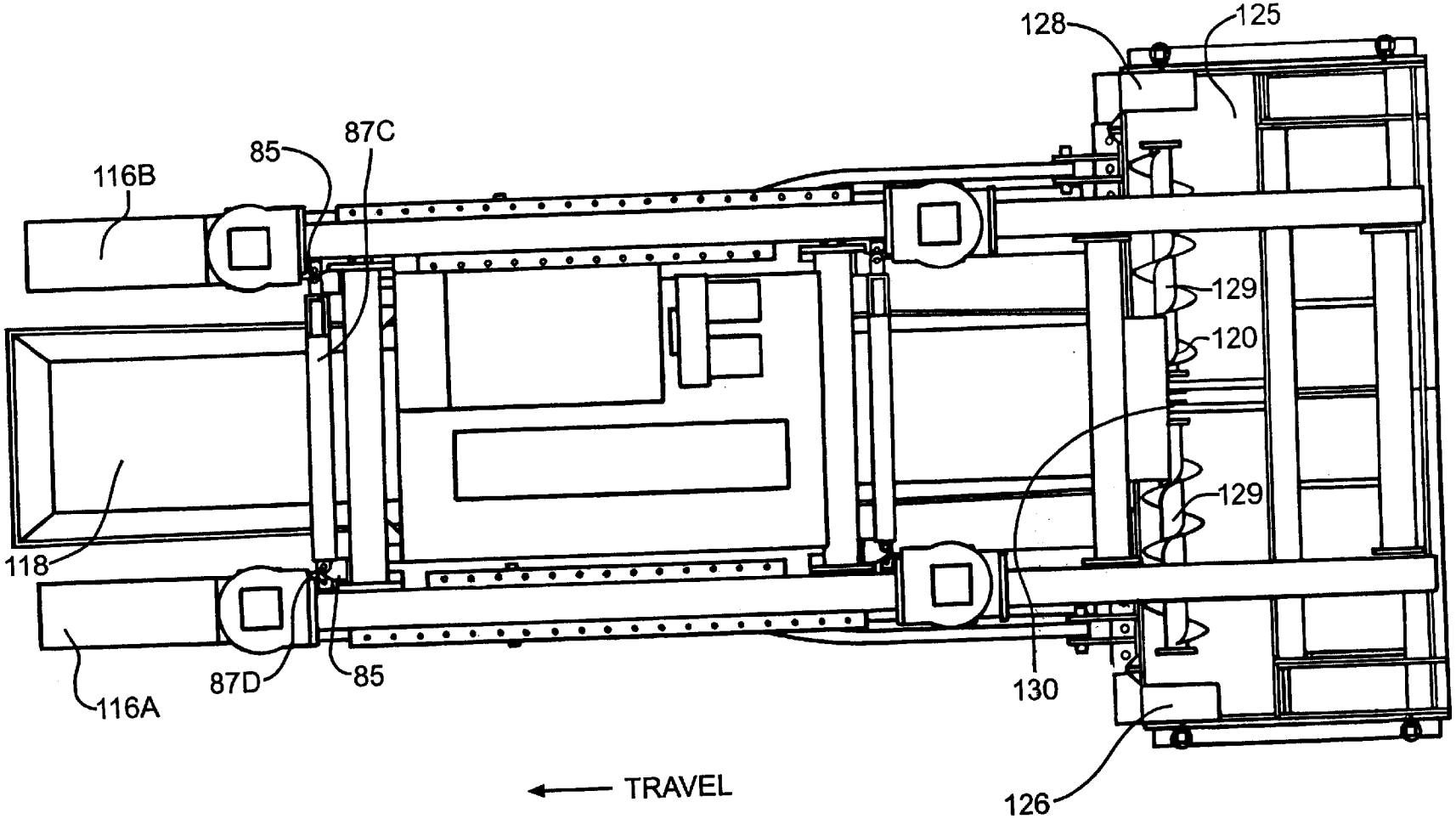
FIG. 7 is a plan view of the paving machine in an unexpanded zero clearance mode.
Figure 8:
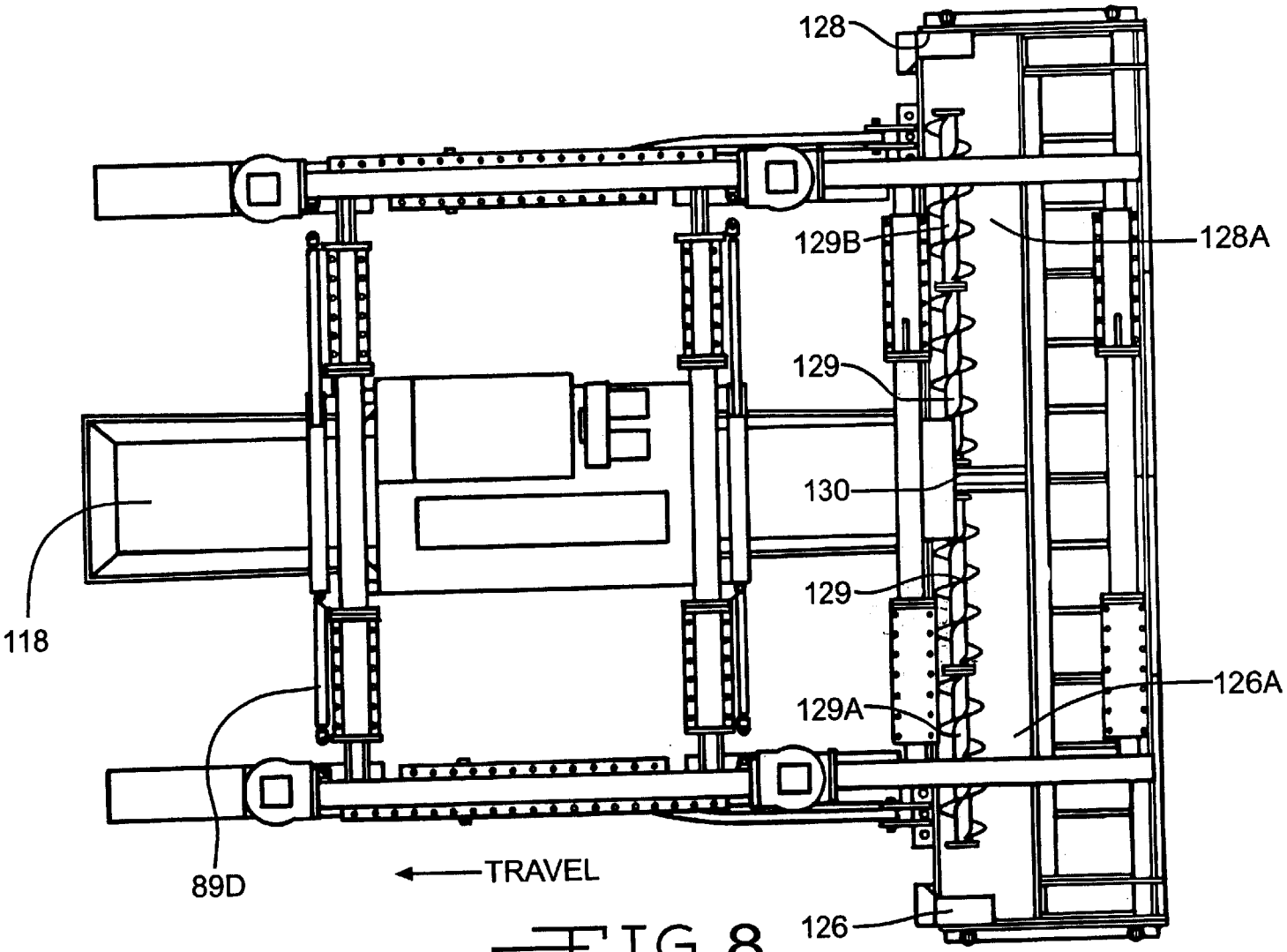
FIG. 8 is a plan view of the paving machine in an expanded zero clearance mode.

In a manner similar to both the mainframe 20, and the pan support frame 21, the concrete pan section 14 can be extended as shown in FIGS. 7 and 8. The end sections generally designated as 126 and 128 are removable and new pan sections can be added, generally designated as 126A and 128A, and additional distribution means extensions generally designated as 129A and 129B, and then the mechanism is reassembled.

In the normal paving mode as shown in FIGS. 10 and 11, longitudinal beams 26 and 28 may be attached to an extension 23 or to the tractor 12. In the normal paving mode, as shown in FIG. 10, the paving pan 16 is attached to support plates 62 and 64 located on the respective lower surfaces 37 and 45 of longitudinal beams 26 and 28. The same paving pan assembly 16 can be used in both conventional and zero clearance modes. The pan will be described in detail in a further section.

Figure 2:
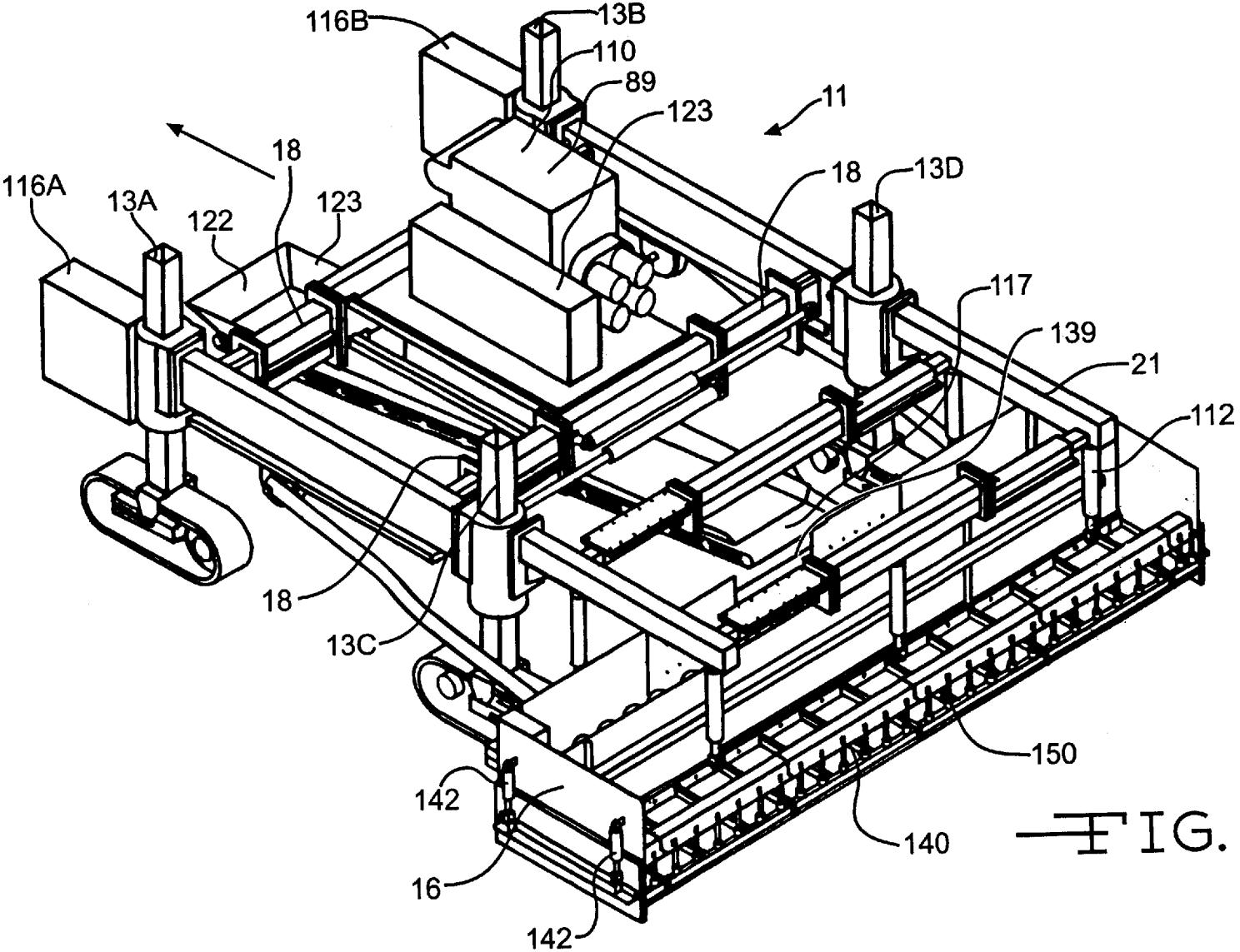
FIG. 2 is a perspective detailed view of the paving machine in an expanded zero clearance paving mode.
Figure 3:
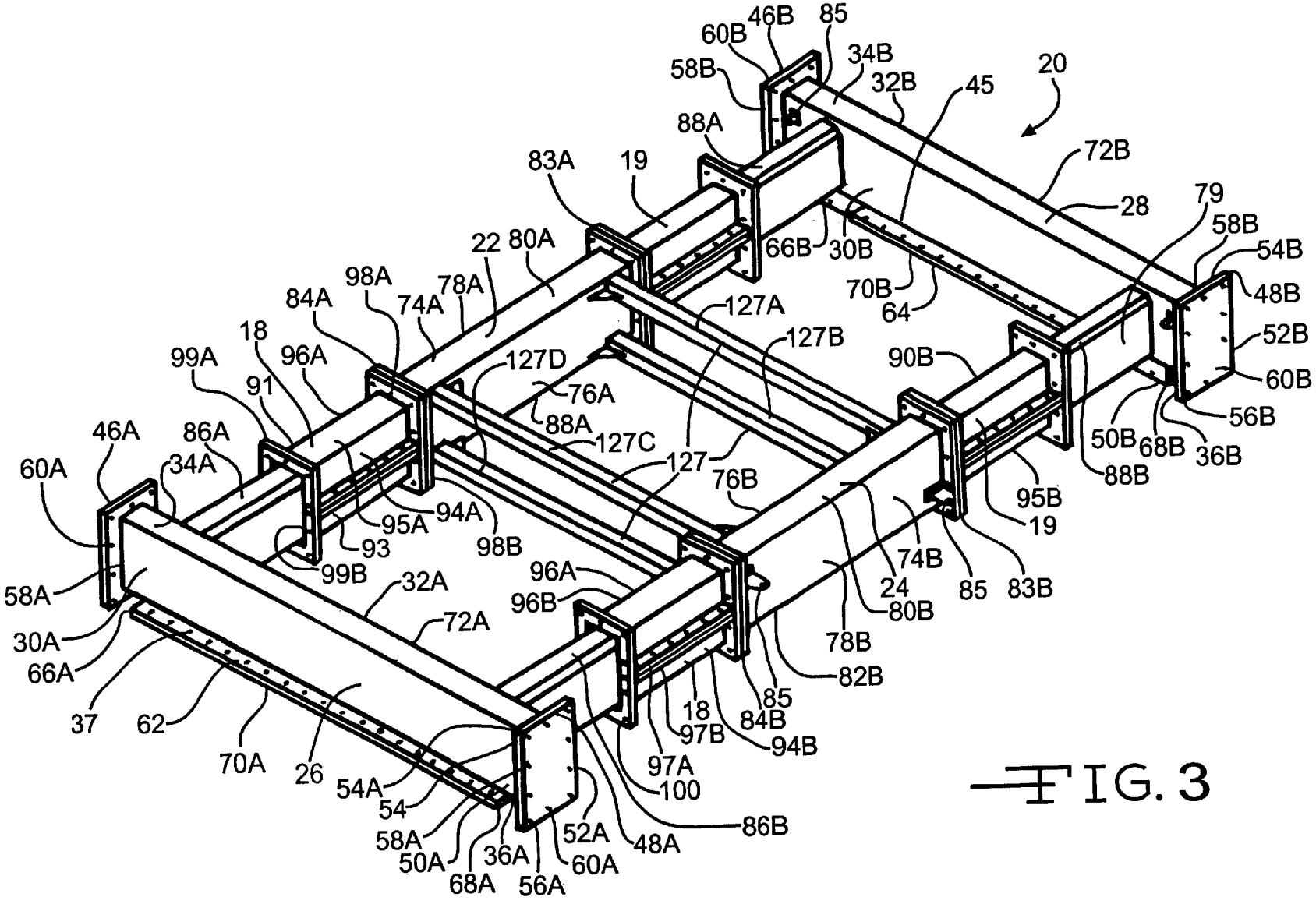
FIG. 3 is a perspective detailed view of the structural frame of the tractor assembly.

In the zero clearance paving mode as shown per FIGS. 1 and 2, paving pan 16 is attached to the mainframe 20 by the pan support frame 21. As further shown in FIG. 4, the pan support frame 21 has first and second transverse support beams 103 and 104 and first and second longitudinal supports 101 and 102. Transverse support beams 103 and 104 are identical and longitudinal supports 101 and 102 are mirrored. Longitudinal supports 101 and 102 are attached to the third and fourth means of motion 13C and 13D respectively. As further shown in FIG. 4, the first transverse support beam 103 contains a main box beam 105 having first and second expansion beams of identical smaller cross-sectional area 106A and 106B disposed inside of the main box beam 105 in a closely spaced stacked relationship capable of being extended as required for paving wider concrete pavements. The ends of the first box beam are closed by plate flanges 125A and 125B, attached to the respective ends of the beam. Both flanges 125A and 125B contain generally rectangular openings 129A and 129B, respectively. Beam 106A fits through the opening 129A and beam 106B fits through opening 129B. The first expansion beam 106A is attached perpendicularly to the first longitudinal support beam 101, whereas the second expansion beam 106B is attached perpendicularly to the second longitudinal support beam 102 of the support frame. Similarly, the second transverse support beam contains a main box beam 147 having a first and second expansion beams of identical smaller cross-sectional area 148A and 148B disposed inside of the main box beam 147 in a closely spaced stacked relationship capable of being extended as required for paving wider concrete pavements. The first expansion beam 148A is perpendicularly attached to the first longitudinal support beam 101, whereas the second expansion beam 148B is attached perpendicularly to the second longitudinal support beam 102 of the support frame 21 for pan 16. The first and second longitudinal beams 101 and 102 extend from the intersection of the first traverse beam 103 and extend to and meet perpendicularly with plate flanges 131A and 131B, respectively.

In the expanded configuration of support frame 21 as shown in FIG. 4, the first and second expansion beams of the first transverse beam 103 and of the second beam 104 are supported by collars, generally illustrated at 92. More than one may be required depending on the expansion distance for the width to be paved. In the embodiment shown in FIG. 4, the collars 92A, 92B, 92C, and 92D can be similar to those which have been described for the first and second transverse beams 24 and 26 of the tractor support frame 20.

As those who are skilled in the art will appreciate, the supports of the extensions of beams 22, 24, 103 and 104 are not limited to the collar arrangement, but can take a number of different arrangements. All that is necessary is that the supports maintain structure integrity of the frame to support the static load and resist dynamic changes to the elevation as a result of varying forces during slip form paving in conventional or zero clearance modes.

Figure 6:
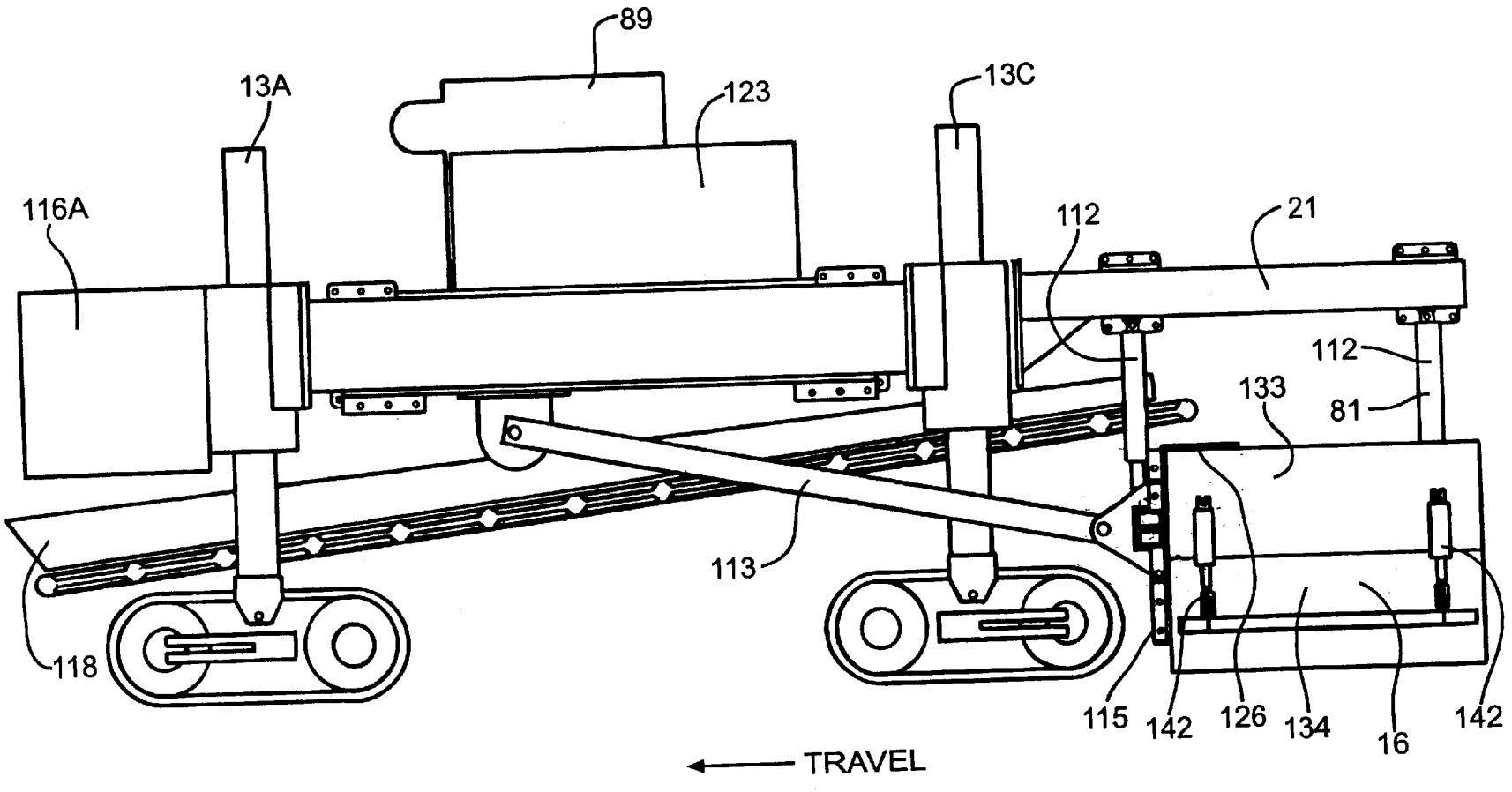
FIG. 6 is a side elevational view of the zero clearance paving machine in an unexpanded mode.

In the zero clearance embodiments shown per FIGS. 1 and 2, the paving pan 16 is attached to the support frame 21 by hydraulic means 110 including a level control 111 (not shown) and at least four hydraulic cylinders, generally illustrated at 112. The pan 16 is also connected to the main support frame by support members 113 and 114 located near the midpoint of the plates 62 and 64 and attached to the lower surfaces 37 and 45 of longitudinal beams 26 and 28, respectively, and the rear surface 115 of paving pan 16 (FIG. 6). Also in the zero clearance mode shown in FIG. 1, counterweights 116A and 116B are attached to the first and second traction means 13A and 13B opposite the paving pan 16. Without the counterweights 116A and 116B, the machine 11 tends to lift up in the front and a consistent concrete slab finish elevation is difficult to maintain. The counterweights are variable and their actual weight depends on the expansion width of the machine and paving assembly. The purpose of the counterweights is to maintain the center of gravity and the center of moments in the center of the main support frame 20 during paving in the zero clearance mode.

In either the conventional or zero clearance mode, paving material such as concrete is delivered to the pan either by a conveyor 118 as shown in FIG. 6 or by ground delivery (not shown). When using ground delivery, skirts (not shown) are used to direct the flow of the concrete mixture away from the path of the traction means. In conveyor delivery, as shown in FIGS. 7 and 8, the auger assembly 129 receives the concrete mixture from the conveyor 118 and moves the concrete from the center to the sides of the pan hopper 125. The slip forming process requires the finishing pan, generally illustrated at 124, to be maintained in a level position at all times (FIG. 1). Vibrators (not shown) are used to distribute the concrete under the finishing pan 124 evenly and prevent excessive lifting force from the compacting concrete. The vibrators frequency is transmitted under the concrete to consolidate the concrete so pan 124 can finish the surface. The vibrators are monitored to maintain a consistent distribution of concrete.

As shown in FIGS. 7 and 8, the paving pan 16 is designed to utilize a standard center section 10 feet wide with a main auger assembly 129. Side sections 126 and 128 are connected to the center section 130 for easy removal. Side sections 126 and 128 contain companion hydraulic motors and drive gears for the auger assembly 129. When wider pan widths are required for increased slab width, side sections 126 and 128 are disconnected and removed. The additional pans and auger extensions 129A and 129B are added and are reconnected to the ends 126 and 128.

Figure 9A:
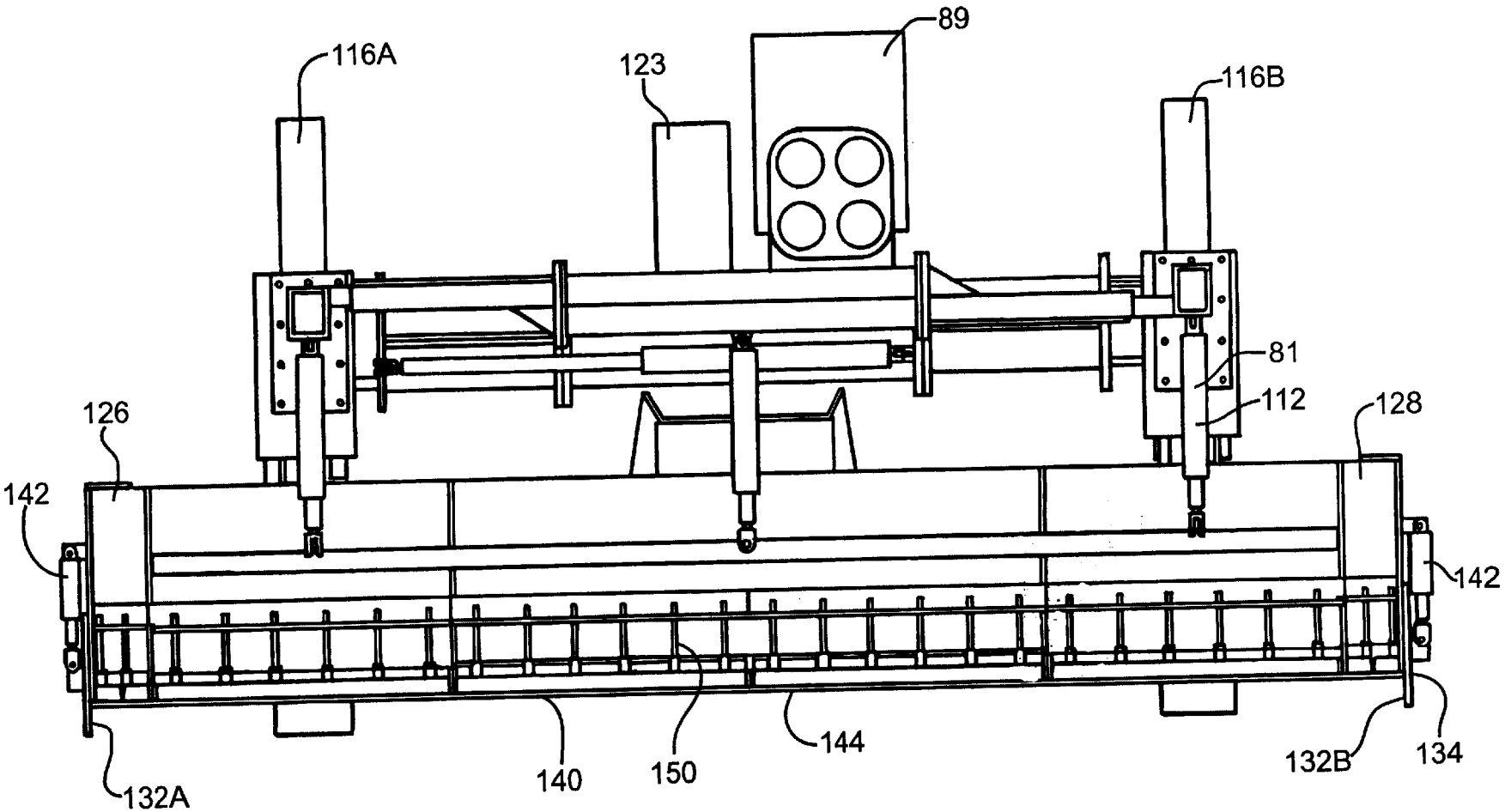
FIG. 9A is a front elevational view showing the paving assembly with the paving pan in a horizontal plane.
Figure 9B:
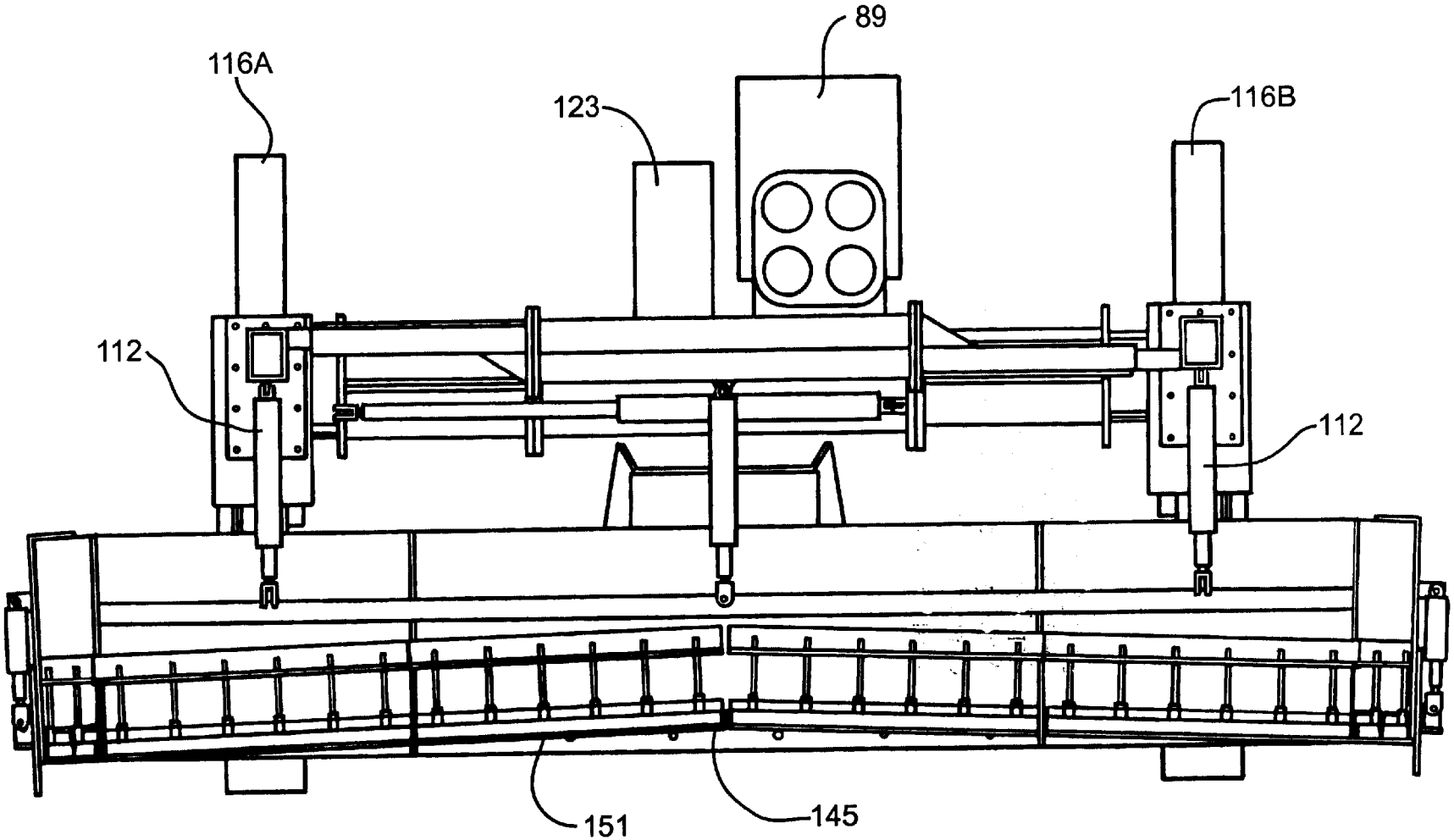
FIG. 9B is a front elevational view showing the paving assembly with paving pan in a center elevated position.

The end views as shown in FIGS. 9A and 9B are equipped with hydraulic skirts 132A and 132B to vary the depth of the slip-formed concrete slab. The finishing portion of the pan 140 is removable and can be modified. Each individual finishing pan section 140 elevation can be adjusted by adjustment threads, generally illustrated at 150, located on each individual pan section.

As shown in FIGS. 1 and 6, the pan mechanism 16 is connected to the pan support mainframe 21, as shown in FIG. 6, by elevational adjustment means 81. The elevational adjustment 81 means include as at least four hydraulic cylinders, generally illustrated at 112, connected to a hydraulic power supply 89. The upper portion 133 consists of generally rectangular left and right side skirts 135 and 136, defining the upper limits of the pan portion. Each skirt consists of a side portion 137 and a rear portion 138. The rear panel 139 of the upper end section generally defined by the left and right rear end sections 138A and 138B is discontinuous, and defines an opening 139A therebetween. The opening 139A may be used to insert a transportation means 117 which will transport the concrete mixture mass from the front to the rear of the machine 11 when a non-ground delivery mechanism is employed. In FIG. 6, an embodiment of the present invention is shown having a conveyor with a continuous belt 118 fed by a generally rectangular feed hopper 122 with sloping sidewalls 123. However, as those who are skilled in the art can realize, the transportation means is not limited to a mechanical belt conveyor: a mechanical screw, pneumatic conveyor piston pump and the like can also be used to transport concrete from the front to the rear of machine 11.

As shown in FIG. 1, the lower portion of the pan 134 is attached to the upper portion 133 by hydraulic means 142, containing a distribution means 119 in which concrete delivered to the distribution header 121 is moved in a general manner from the center section to the edges of the header. As previously stated, the embodiment of distribution means shown in FIG. 7 consists of dual individual drives 126 and 128, respectively, and a screw transport 120. The delivery mechanism further includes a vibration means (not shown) to assist in compaction of the concrete mixture and to prevent excessive lifting force from the compacted concrete. As previously stated, the lower portion of the pan 134 further contains skirts generally designated as 132A and 132B which form the basis of the side forms for the paving slab.

The finishing section of the pan generally is designated at 140. This is considered part of the lower portion 134 of the pan. The finishing section is adjusted using at least two of the elevational means 112, as shown in FIG. 9A. In the first embodiment of the pan section shown in FIG. 9A, the pan section is generally horizontal, consisting of a flat planar surface 144 which is normally used to pave most road slabs. This embodiment has been previously discussed. However, the second embodiment shown in FIG. 9B is used when a crown 145 is required in the pavement. A crown is a high point in the surface created to improve drainage runoff over the paved surface. The center portion of the finishing pan is raised creating a non-horizontal surface 151.

Now, it is therefore apparent that the present invention accomplishes its intended objects. While embodiments of the present invention have been described in detail, which is for the purpose of illustration, not limitation.

We claim:

1. A concrete paving machine comprising:

a) a main frame comprising a front end and a rear end;

b) a first front track mechanism and a second front track mechanism the first and second front track mechanisms for supporting the front end of the main frame, and a third track mechanism and a fourth track mechanism the third and fourth track mechanisms for supporting the rear end of the main frame, and a means for driving the first front track mechanism, second front track mechanism, third back track mechanism, and fourth back track mechanism;

c) a pan support frame which extends outward from the rear end of the main frame;

d) hydraulic cylinders connected to and extending from the pan support frame;

e) a paving pan assembly connected to the hydraulic cylinders, the paving pan assembly located at and extending from rear end of the main frame;

f) wherein widths across the two front track mechanisms and the two rear track mechanisms are less than a width of the paving pan assembly, allowing for zero clearance paving on both sides of the paving pan assembly; and g) a first weight mounted to the first front track mechanism and a second weight mounted to the second front track mechanism, the first and second weights at the front end of the main frame and opposite the paving pan assembly extending from the rear end of the main frame, the first and second weights for balancing the paving machine.

2. The paving pan according to claim 1 further comprising pan extension sections, the pan extension sections are releasably attached to the pan assembly and are for expanding the width of the paving pan assembly.

3. The paving pan according to claim 2 further comprising a plurality of paving pan extension sections, wherein each extension section further comprises an auger extension, the auger extension being releasably joined with adjacent augers.

4. The paving pan assembly according to claim 1 further comprising a paving pan extension section releasably attached to the paving pan assembly for expanding the width of the paving pan assembly and wherein the main frame is expandable so that as the width of the paving pan increases due to the addition of the pan extension section the width of the main frame increases providing for stability.

5. A method of paving a surface with a paver comprising the steps of:

a) providing the paver with a main frame comprising a front end and a rear end;

b) providing a first front track mechanism and a second front track mechanism the first and second front track mechanisms for supporting the front end of the main frame, and providing a third track mechanism and a fourth track mechanism the third and fourth track mechanisms for supporting the rear end of the main frame, and providing a means for driving the first front, second front, third back and fourth back track mechanisms;

c) providing a pan support frame which extends outward from the rear end of the main frame;

d) providing hydraulic cylinders connected to and extending from the pan support frame;

e) providing a paving pan assembly connected to the hydraulic cylinders, the paving pan assembly located at and extending from rear end of the main frame;

f) establishing a width between the two front track mechanisms and establishing a width between the two rear track mechanisms, with the widths being less than a width of the paving pan assembly, allowing for zero clearance paving on both sides of the paving pan assembly; and g) mounting a first weight to the first front track mechanism and mounting a second weight mounted to the second front track mechanism, the first and second weights at the front end of the main frame and opposite the paving pan assembly extending from the rear end of the main frame, the first and second weights for balancing the paving machine.

h) supplying a mass of material to be deposited to the paving pan assembly and depositing the mass of material.

* * * * *